United States Patent [19]

de Larosiere

[11] Patent Number: 4,886,198

[45] Date of Patent: Dec. 12, 1989

[54] DEVICE FOR SEPARATING PERFORATED STRIPS FROM PAPER SHEETS

[76] Inventor: Pierre J. de Larosiere, 30 Duque de Palmela, 4C 1200, Lisbon, Portugal

[21] Appl. No.: 228,713

[22] Filed: Aug. 5, 1988

Related U.S. Application Data

[63] Continuation of Ser. No. 936,799, Dec. 2, 1986, abandoned.

[51] Int. Cl.[4] ..... B26F 3/02

[52] U.S. Cl. ..... 225/106; 225/1

[58] Field of Search ..... 225/1, 93, 101, 106; 30/DIG. 3

[56] References Cited

U.S. PATENT DOCUMENTS

| | | | |
|---|---|---|---|
| 432,632 | 7/1890 | Merriman | 30/DIG. 3 X |
| 2,812,567 | 11/1957 | Zalkind | 225/101 |
| 3,190,516 | 6/1965 | Eriksen | 225/101 |
| 4,529,113 | 7/1985 | Elliott | 225/1 |
| 4,657,163 | 4/1987 | Cats | 225/1 X |

*Primary Examiner*—Frank T. Yost
*Assistant Examiner*—Michael D. Folkerts
*Attorney, Agent, or Firm*—Dennis H. Lambert

[57] ABSTRACT

A device for separating the perforated strips from the side edges of sheets of computer printout paper or similar paper and like products. The device has a main body with limit stops for accurately positioning a sheet of paper inserted into the device and a hinged top adapted to be folded over the body to grip and hold the edge of a sheet or sheets of paper inserted into the device. The top has teeth which extend into the perforations of the paper and a clamping edge to engage and securely hold the strip of paper while the sheets are separated by pulling them away from the device. The device may be provided with indicia to form a scale or other implement, and in one form of the invention has a shaped end and edge defining a letter opener and/or a tool for separating the sheets of paper along their fold lines.

11 Claims, 7 Drawing Sheets

DEVICE FOR SEPARATING PERFORATED STRIPS FROM PAPER SHEETS

This is a continuation of application Ser. No. 936,799, filed Dec. 2, 1986, now abandoned.

DESCRIPTION

1. Technical Field

This invention relates generally to tools or implements for home, school and/or office use. More particularly, the invention relates to a device for removing the perforated strips along the edges of computer printout paper or like products.

2. Background Art

With the ever increasing usage of computers, there has been an equally increasing usage of printing devices. These printing devices have toothed mechanisms which engage in the holes of perforated strips along the edges of the paper to feed and guide the paper through the printer. These perforated guide strips are joined to the main body of the paper by a tear line so that the strips can be torn from the main body of the paper. However, this operation is tedious and often results in tearing the paper itself.

DISCLOSURE OF THE INVENTION

Accordingly, an object of this invention is to provide a device for removing the perforated strips along the edges of computer printout paper or other products with a minimum amount of effort and a greatly reduced risk of tearing the paper.

Another object of the invention is to provide a tool for assisting in removing strips from the edges of sheets of paper, and in which the tool has other functional uses, i.e., as a letter opener or measuring implement.

A further object of the invention is to provide a simple and economical device for removing the perforated strips from the edges of computer printout paper, and for facilitating the separation of sheets of the paper along the fold lines of the paper.

These and other objects and advantages of the invention are accomplished by the unique device discovered by applicant. In accordance with the invention, a device is provided for gripping the perforated edge of a sheet or sheets of computer printout paper or similar products, whereby the main body of the paper may be grasped and torn away from the strips with a minimum amount of effort and a substantially reduced risk of tearing the paper itself.

The device includes a main body having limit stops thereon for accurately positioning a sheet or sheets of paper inserted into the device, and a top hinged to the main body in a position to be folded over the main body into clamping relationship with the edge of a sheet or sheets of paper inserted into the device. The top has a plurality of teeth formed thereon in positions to extend into the perforations of the strips of paper, and a clamping edge for engaging the strip to securely hold the strip to the device while the main body of the paper is torn away from the strip. Cooperating guides are formed on the main body and the top of the device for accurately aligning the top relative to the main body when the device is closed into clamping relationship on the edge of a sheet or sheets of paper, and indicia may be provided on the device to form a scale or other useful implement. In addition, the device may have one edge and end shaped to define a letter opener or tool for engaging and separating sheets of paper along the fold lines of the paper.

BRIEF DESCRIPTION OF THE DRAWINGS

The foregoing and other objects and advantages of the invention will become apparent from the following description, taken in conjunction with the drawings, wherein like reference characters designate like parts throughout the several views, and wherein.

BEST MODE FOR CARRYING OUT THE INVENTION

Figure 1:
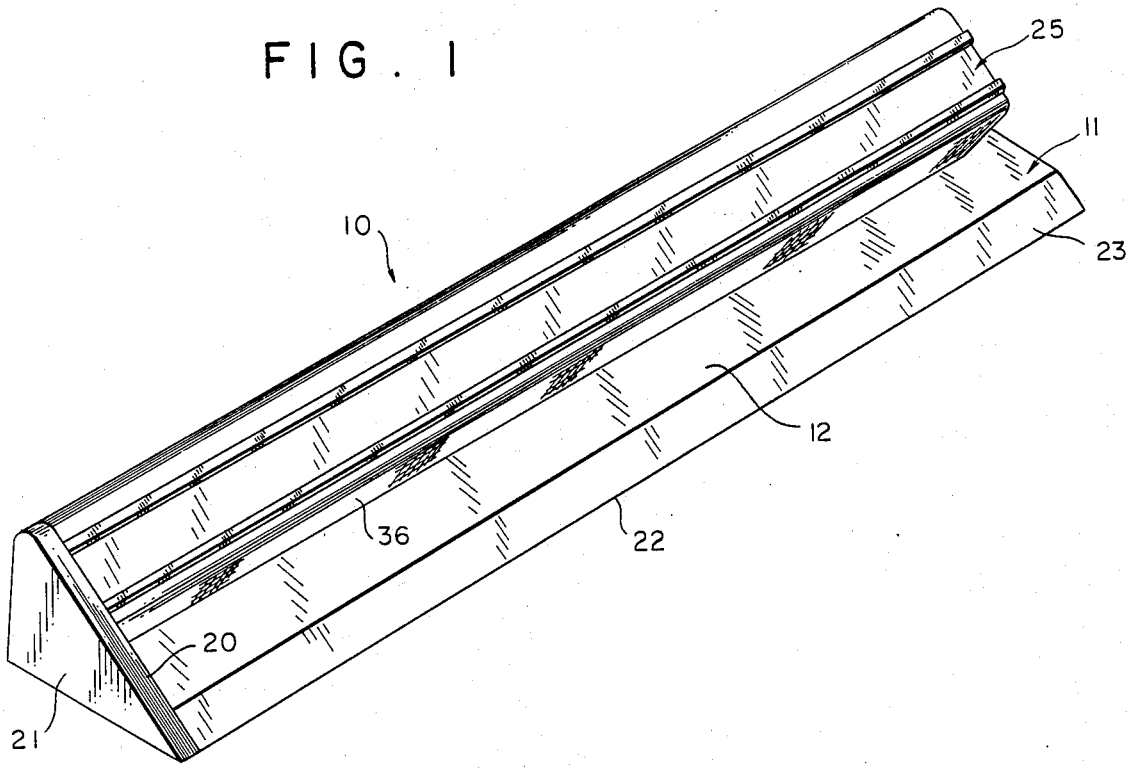
FIG. 1 is a top perspective view of a first form of the invention, with the device in a closed position.
Figure 2:
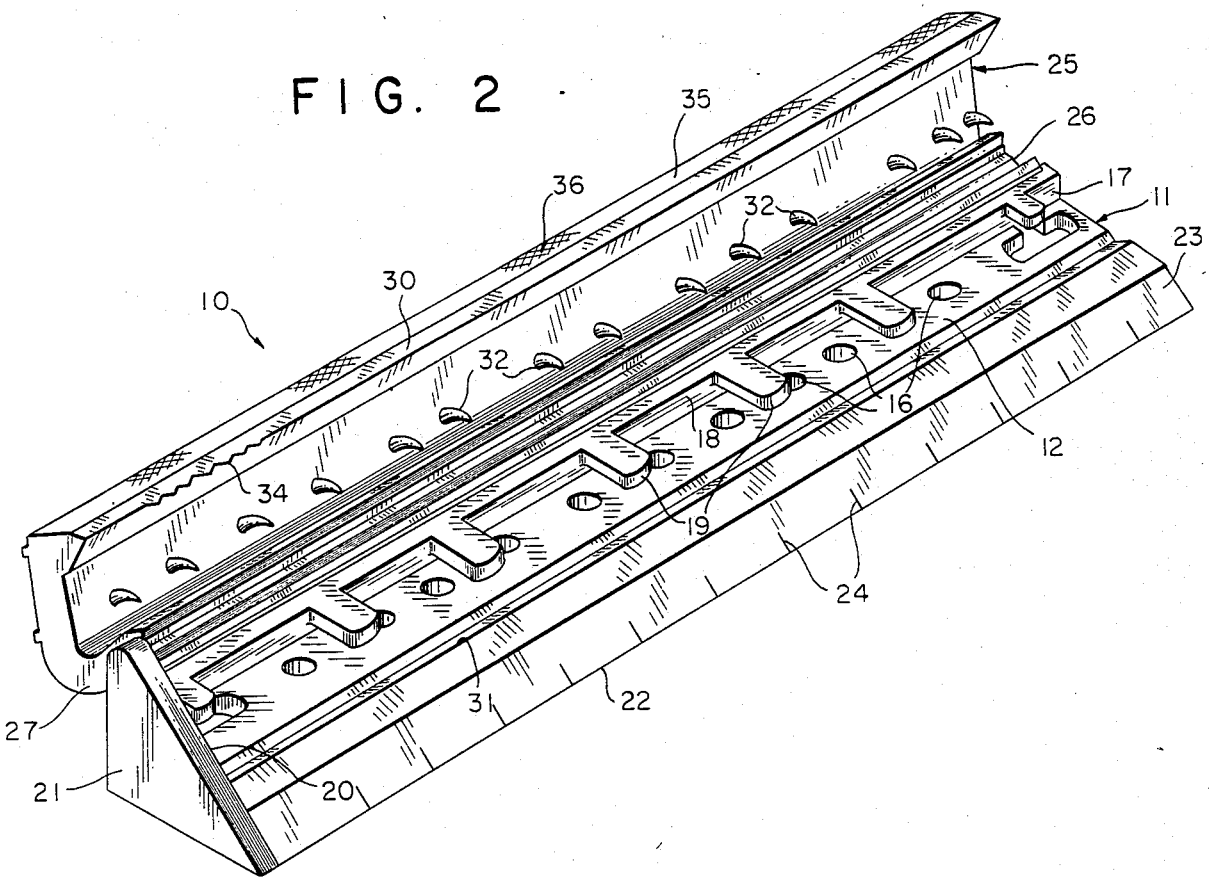
FIG. 2 is a top perspective view of the device of FIG. 1, showing the top opened.

Referring more specifically to the drawings, a first form of the invention is represented generally at 10 in FIGS. 1 through 14 and comprises a substantially flat main body portion 11 having essentially parallel top and bottom surfaces 12 and 13, respectively. A pair of shallow, elongate recesses or channels 14 and 15 are formed in the bottom surface 13 and extend throughout almost the entire length of the main body. A plurality of openings 16 are formed through the main body in predetermined spaced relationship along a rearward portion thereof in registry with the channel 15 in the bottom surface 13. An upstanding wall or flange 17 is formed along the rearward edge of the main body portion 11, and defines a first limit stop 18 at the rear of the device.

A plurality of generally uniformly spaced apart retainers 19 are formed on the top of the wall 17 and extend forwardly over the top surface 12 in spaced relationship thereto. These retainers define a set of second limit stops for limiting the maximum number of sheets of paper that can be inserted into the device. A third limit stop 20 is formed at one end of the main body portion 11 by end wall 21, and serves to accurately align the perforations P (see FIG. 11) in the sheets of paper with the openings 16 in the main body portion 11.

The forward edge 22 of the main body portion 11 is tapered at 23, and suitable indicia 24 may be provided thereon to form a scale or the like.

Figure 6:
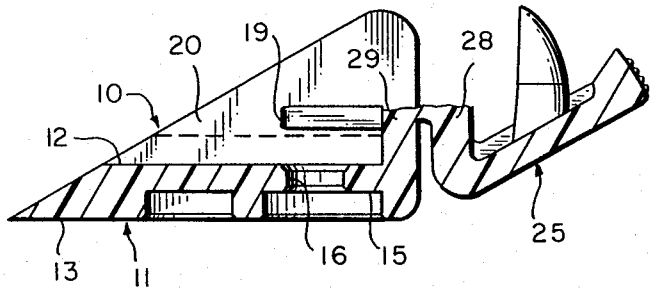
FIG. 6 is a transverse sectional view taken along line 6—6 in FIG. 3.
Figure 7:
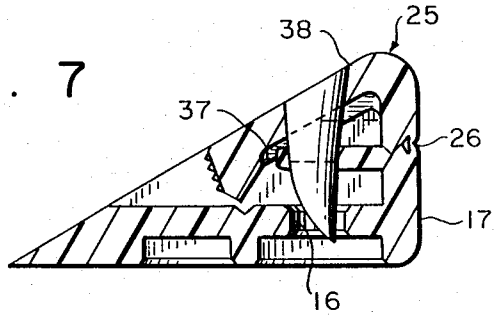
FIG. 7 is a transverse sectional view taken along line 7—7 in FIG. 4.
Figure 8:
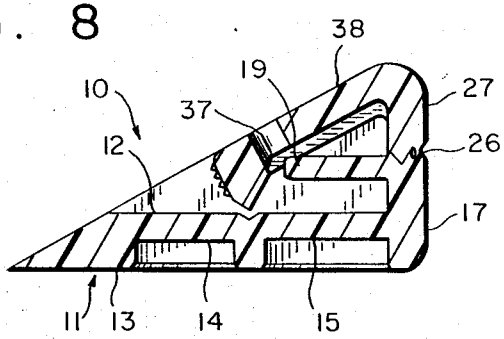
FIG. 8 is a transverse sectional view taken along line 8—8 in FIG. 4.
Figure 3:
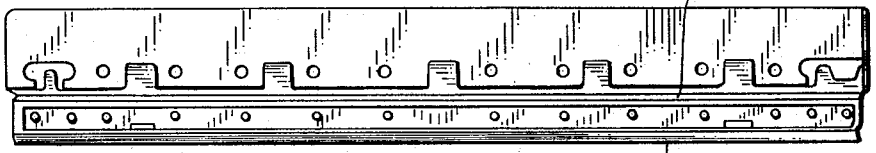
FIG. 3 is a top plan view looking down on the device in a fully opened position.
Figure 4:
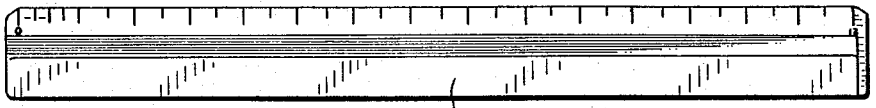
FIG. 4 is a top plan view looking down on the device in a closed position.
Figure 5:
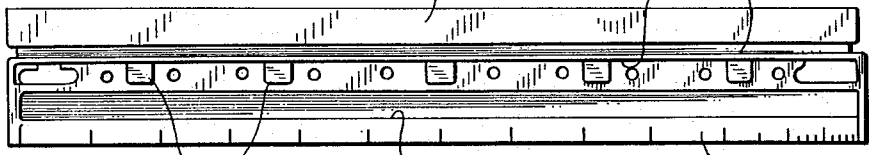
FIG. 5 is a bottom plan view of the device in an open position.
Figure 9:
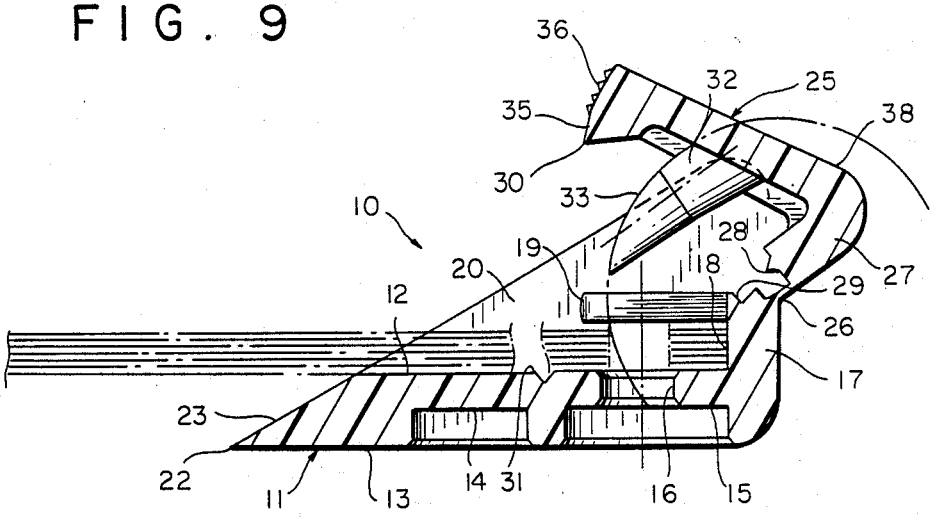
FIG. 9 is a transverse sectional view similar to FIG. 7, showing the top in an intermediate position and being closed on a plurality of sheets of paper inserted in the device.
Figure 10:
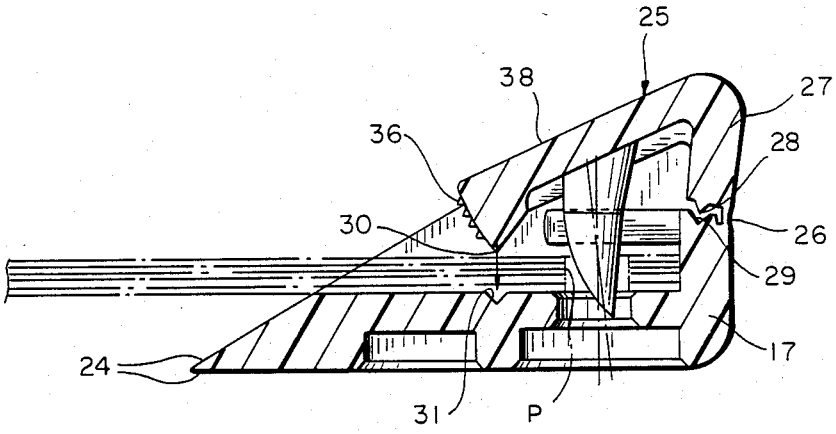
FIG. 10 is a view similar to FIG. 9, showing the device in a fully closed position on the paper inserted therein.

A top 25 is hinged to the top of the wall 17 on main body portion 11 via a living hinge 26 for pivoting movement between a fully opened position as shown in FIGS. 3 and 6 to a fully closed position as shown in FIGS. 4 and 7. As seen best in FIGS. 2, 3 and 6 through 10, the top 25 has a rear wall 27 joined at its lower edge to the living hinge 26, and the confronting surfaces of this wall 27 and rear wall 17 on the main body portion 11 have mating guide surfaces formed thereon for guiding the top relative to the main body portion during the final closing movement of the top. In the specific structure shown, these guide surfaces comprise an elongate wedge-shaped closing guide 28 on the bottom surface of the rear wall 27 and a complementally shaped recess 29 on the top surface of the rear wall 17.

The forward edge of top 25 has a shaped blade 30 formed thereon for clamping engagement with the edge of a sheet or sheets or paper inserted into the device under the retainers 19. A complementally shaped channel 31 is formed in the top surface 12 of main body portion 11, whereby a secure gripping action is exerted on the edges of sheets of paper inserted into the device by the cooperating action of the blade 30 and recess 31.

A plurality of retaining teeth 32 are formed on the underside of top 25, spaced along its length in positions to be in registry with the openings 16 in the main body portion 11 when the top is closed. The forward surfaces of these teeth are arcuately curved at 33, along a path lying on a circle having its center at the axis of the living hinge 26, whereby the teeth will clear the side of opening 16 during closing movement of the top (see FIG. 9). These retaining teeth are spaced and positioned so as to extend into the perforations P in the strips along the sides of computer printout paper when the paper is properly located in the device against the first and third limit stops. In this connection, it should be noted that the center-to-center distance between the perforations and the distance from the perforations to the outside edge of the paper are universal. However, there are variations in the distance between the perforations and the tear line joining the strip to the main body of the paper. The spacing of the blade 30 and cooperating recess 31, and the location of the teeth 32 are selected so that the device of the invention is compatible with all presently available computer printout papers. Moreover, the edge of the blade 30 may have small teeth or other gripping surfaces 34 thereon to enhance the gripping action on paper inserted in the device. In addition, the spacing of the blade 30 identical to that previously described.

Figure 11:
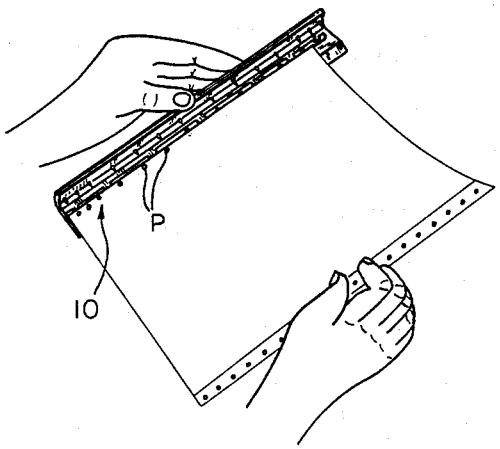
FIG. 11 is a top perspective view showing a sheet of paper being inserted into the device.
Figure 12:
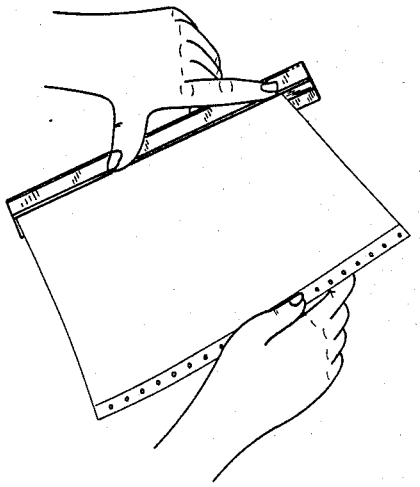
FIG. 12 is a view similar to FIG. 11, showing the paper fully inserted and the top closed.
Figure 13:
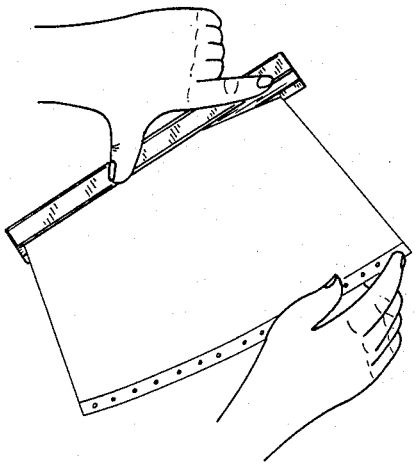
FIG. 13 is a view similar to FIG. 12, showing the paper being grasped and torn away from the edge held in the device.
Figure 14:
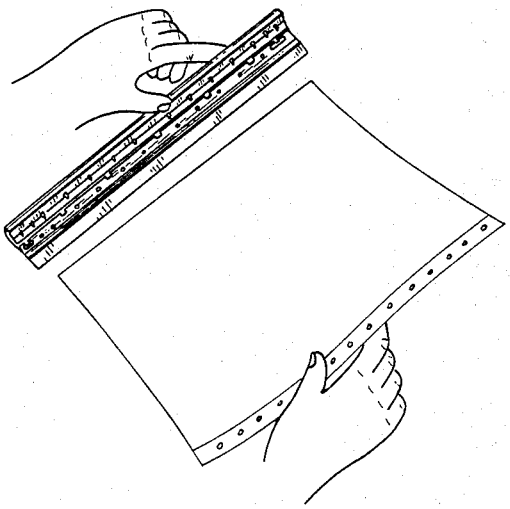
FIG. 14 is a view similar to FIG. 13, showing the paper fully torn away from the edge held in the device.
Figure 15:
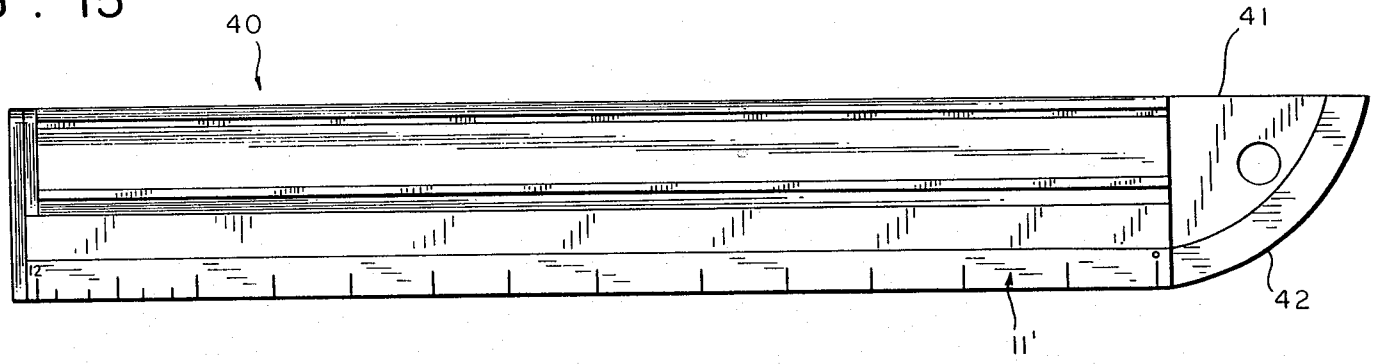
FIG. 15 is a top plan view of a modified device, shown in the closed position.
Figure 16:
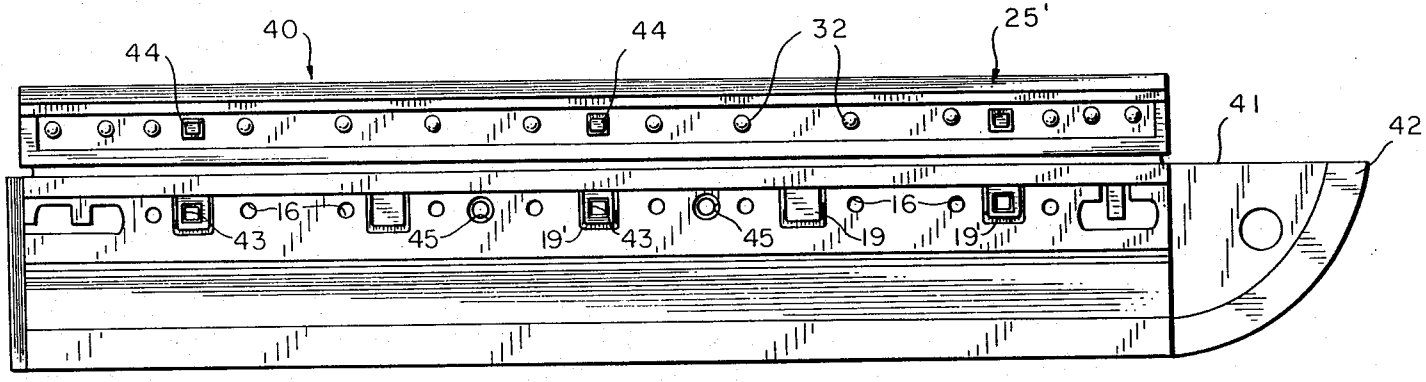
FIG. 16 is a top plan view of the device of FIG. 15, with the device in a fully opened position.
Figure 17:
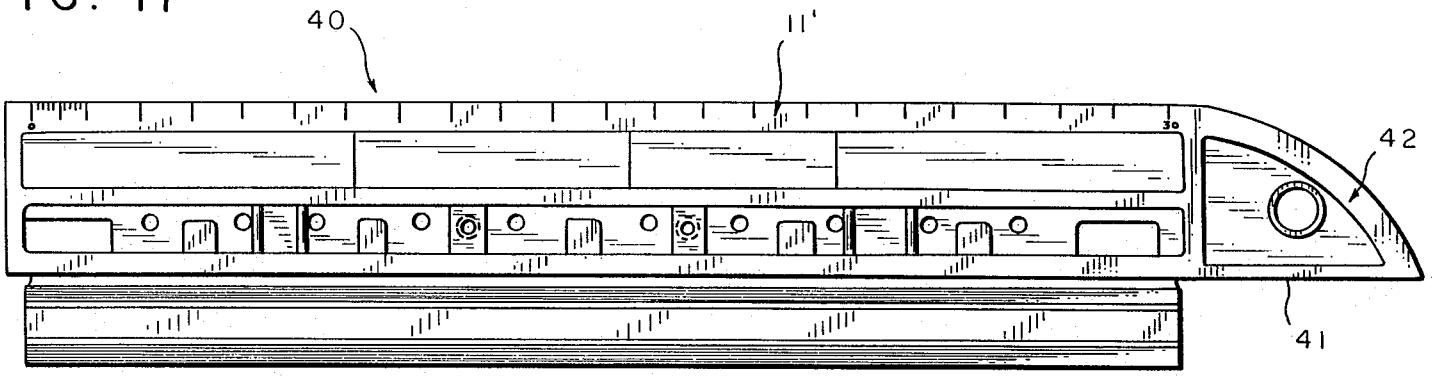
FIG. 17 is a bottom plan view of the device, with the device in a fully opened position.
Figure 18:
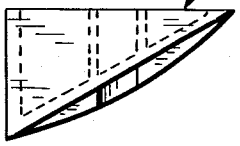
FIG. 18 is a transverse sectional view taken along line 18—18 in FIG. 17.
Figure 19:
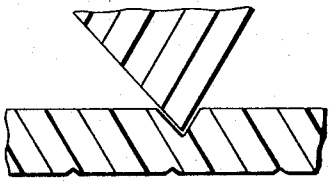
FIG. 19 is a greatly enlarged, transverse sectional view taken along line 19—19 in FIG. 17, showing the clamping edge on the top of the device.
Figure 20:
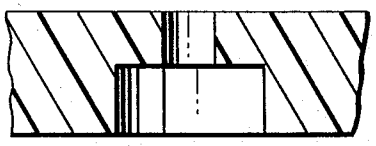
FIG. 20 is a greatly enlarged, fragmentary sectional view taken along line 20—20 in FIG. 17.
Figure 21:
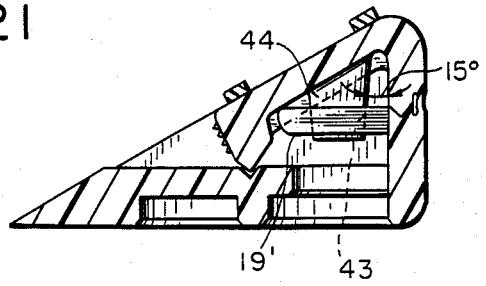
FIG. 21 is a transverse sectional view taken along line 21—21 in FIG. 15.
Figure 22:
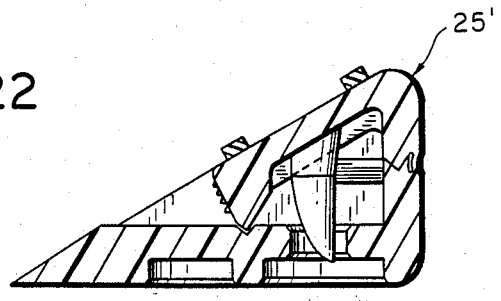
FIG. 22 is a transverse sectional view taken along line 22—22 in FIG. 15.
Figure 23:
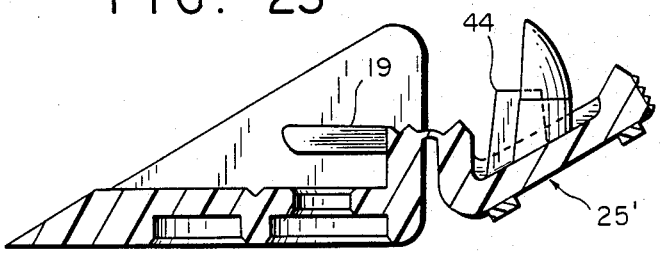
FIG. 23 is a transverse sectional view taken along line 23—23 in FIG. 16.
Figure 23A:
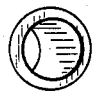
FIG. 23A is a plan view of a portion of FIG. 23.

The manner of use of the device in removing the perforated strip along the edges of sheets of computer printout paper is illustrated in FIGS. 11 through 14. As seen in FIG. 11, a sheet or sheets of computer printout paper or the like are placed in the device by sliding them over the main body portion 11, under the retainers 19, until the left hand side and bottom edge of the paper engage the limit stops 18 and 20, respectively. The top 25 is then closed over the edge of the paper, resulting in the teeth 32 being extended through the perforations in the strips at the side of the paper, and the blade 30 being firmly clamped against the perforated strip, either at the tear line or between the tear line and the outer edge of the strip, depending upon the dimensions of the particular paper. One hand is then placed on the top to hold it closed firmly on the paper, as shown in FIG. 13, and the paper is pulled away from the device by exerting an outward and downward pull to separate the sheet(s) from the perforated strip(s). The top is then opened, as shown in FIG. 14, and the strips simply dumped out of the device by tilting the device.

While the invention has been illustrated and described in detail herein, it is to be understood that various changes in construction and operation can be made without departing from the spirit thereof as defined by the scope of the claims appended hereto.

It is claimed:

1. A device for separating the perforated transport edge or strip from sheets of computer paper or the like, wherein the strip is joined to the sheet via a frangible tear line, comprising:

a main body having limit stop means for engaging and accurately positioning a sheet of paper or the like placed thereon;

a top hinged to the main body at a hinge means along one side and adapted to be swung from a first position overlying the main body to a second position away from the main body;

means on said top for engaging and holding the narrow strip while the sheet is pulled away from the device, thus tearing the strip from the sheet, said means comprising a plurality of openings in said main body and a plurality of hook-like teeth on said top projecting therefrom in positions to extend into the openings when the top is in its first position, said limit stop means configured to position the paper placed thereagainst so that the perforations in the transport strip are aligned with the openings in the main body, whereby said hook-like teeth extend through the openings in the strip and into the openings in the body to hold the strip securely in place when the top is in its first position.

2. A device as claimed in claim 1, wherein:

a clamping blade is on the side of said top opposite said hinge means for engaging and clamping a sheet or sheets of paper or the like between the blade and main body when the top is closed over the main body.

3. A device as claimed in claim 2, wherein:

interfitting guide surfaces are formed on the main body and top in spaced relation to the hinge means for guiding the top during its closing movement relative to the main body.

4. A device as claimed in claim 1, wherein:

one end of the main body is pointed, and one side edge of the body is tapered to a narrow, knife-like edge, forming a letter opener or tool for separating multiple sheets along frangible fold lines.

5. A device as claimed in claim 4, wherein:

a scale is formed along one edge of the main body.

6. A device for separating a narrow strip from a sheet of paper or the like, wherein the strip is joined to the sheet via a frangible tear line, comprising:

a main body having means for engaging and accurately positioning a sheet of paper or the like placed thereon;

a top hinged to the main body along one side and adapted to be swung from a first position overlying the main body to a second position away from the main body; and gripping means on said top and main body for engaging and holding the narrow strip while the sheet is grasped and pulled away from the device, thus tearing the strip from the sheet, said gripping means including an elongate recess or channel in one of the top and main body and a mating elongate blade-like projection having a tapered knife-like edge on the other of the top and main body, said recess and projection being aligned with one another when the top is in its first position and adapted to engage on opposite sides of the strip to securely grip the strip while the sheet is torn away.

7. A device for separating the perforated transport edge or strip from sheets of computer paper or the like, wherein the strip is joined to the sheet via a frangible tear line and has a plurality of perforations therein, comprising:

a main body having limit stop means for engaging and accurately positioning a sheet of paper or the like placed thereon;

a top hinged to the main body at a hinge means along one side and adapted to be swung from a first position overlying the main body to a second position away from the main body;

means on said top for engaging and holding the narrow strip while the sheet is pulled away from the device, thus tearing the strip from the sheet, said means comprising a clamping blade on the side of the top opposite said hinge means for engaging and clamping a sheet or sheets of paper or the like between the blade and main body when the top is closed over the main body, and a plurality of hook-like teeth on said top projecting therefrom in positions to extend into the perforations in the strip when the top is in its first position, to hold the strip securely in place;

interfitting guide surfaces on the main body and the top for guiding the top during its closing movement relative to the main body; and at least one retainer on said main body, extending forwardly over said main body in spaced relation thereto and defining a limiting spacer for limiting the maximum number of sheets which can be inserted at one time into the device.

8. A device as claimed in claim 7, wherein:

a plurality of spaced apart retainers are provided on the main body, at least one of said retainers having a guide opening formed therein; and said guide means comprises at least one guide pin on the top in a position to extend into said guide opening and guide the top in its closing movement relative to the main body.

9. A device as claimed in claim 8, wherein:

a scale is formed along one edge of the main body.

10. A device as claimed in claim 9, wherein:

one end of the main body is pointed, and one side edge of the body is tapered to a narrow, knife-like edge, forming a letter opener or tool for separating multiple sheet along frangible fold lines.

11. A device for separating a narrow strip from a sheet of paper or the like, wherein the strip is joined to the sheet via a frangible tear line, comprising:

a main body having limit stops for engaging and accurately positioning a sheet of paper or the like placed thereon;

a top hinged to the main body along one side and adapted to be swung from a position overlying the main body to a position away from the main body;

means on said top for engaging and holding the narrow strip while the sheet is pulled away from the device, thus tearing the strip from the sheet; and at least one retainer on said main body, extending forwardly over said main body in spaced relation thereto and defining a limiting spacer for limiting the maximum number of sheets which can be inserted at one time into the device, said retainer having a guide opening formed therein, and at least one guide pin on the top in a position to extend into said guide opening and guide the top in its closing movement relative to the main body.

* * * * *